US006446663B2

(12) United States Patent
Francis

(10) Patent No.: US 6,446,663 B2
(45) Date of Patent: Sep. 10, 2002

(54) DEVICE FOR HOLDING AND STORING AT LEAST TWO DISTINCT SPOOLABLE PIPES

(75) Inventor: Robert Francis, Ecosse (GB)

(73) Assignee: Coflexip, Paris (FR)

( * ) Notice: Subject to any disclaimer, the term of this patent is extended or adjusted under 35 U.S.C. 154(b) by 0 days.

(21) Appl. No.: 09/766,089

(22) Filed: Jan. 19, 2001

(30) Foreign Application Priority Data

Jan. 21, 2000 (FR) ..... 00 00752

(51) Int. Cl.[7] ..... B65H 15/36

(52) U.S. Cl. ..... 137/355.17; 137/355.27; 137/388.6; 137/390.4; 137/390.8

(58) Field of Search ..... 137/355.17, 355.26, 137/355.27; 242/388.6, 388.7, 390.4, 390.8

(56) References Cited

U.S. PATENT DOCUMENTS

| | | | | |
|---|---|---|---|---|
| 1,746,995 A | * | 2/1930 | Edwards | 137/355.17 |
| 2,629,630 A | * | 2/1953 | Roark | 137/355.17 |
| 3,709,252 A | * | 1/1973 | Bishop | 137/355.17 |
| 3,804,111 A | | 4/1974 | Chatard et al. | 137/355.16 |
| 3,941,146 A | | 3/1976 | Chatard et al | 137/355.16 |
| 4,649,954 A | * | 3/1987 | Dunwoody | 137/355.17 |

FOREIGN PATENT DOCUMENTS

| | | |
|---|---|---|
| DE | 19835711 | 12/1999 |
| FR | 2056428 | 5/1971 |
| FR | 2151467 | 4/1973 |
| FR | 2553859 | 4/1985 |

* cited by examiner

*Primary Examiner*—A. Michael Chambers
(74) *Attorney, Agent, or Firm*—Ostrolenk, Faber, Gerb & Soffen

(57) ABSTRACT

It is of the type comprising a first cylindrical structure and a second cylindrical structure with different diameters (1, 2), the main first flexible pipe (8) being held and stored in a first cylindrical structure (1), the two cylindrical structures (1, 2) being concentric, able to rotate about an approximately vertical axis of rotation (A) and having an upper face (1*a*, 1*b*) which is open and a lower face which is closed by an end plate (3), and means (4) for rotating the said cylindrical structures, characterized in that the secondary second pipe (14) is arranged in the second cylindrical structure (2) which comprises three distinct and concentric housings (11, 12, 13), the two end housings, namely the innermost housing (13) and the outermost housing (11), being for holding and storing the said secondary second pipe (14), the central housing (12) constituting a transition zone for the passage of the said secondary pipe (14) between the innermost and outermost housings (11, 13).

Application in particular to underwater flexible pipes.

8 Claims, 2 Drawing Sheets

DEVICE FOR HOLDING AND STORING AT LEAST TWO DISTINCT SPOOLABLE PIPES

The present invention relates to a device for holding and storing at least two distinct spoolable pipes.

In the offshore oil industry, various types of pipes are used, including flexible pipes for transporting fluids such as liquid or gaseous hydrocarbons, water or air. The flexible pipes generally connect one or more items of surface equipment to one or more items of sea-bed equipment such as a production well or a manifold, part of the flexible pipes lying on the sea bed. The structure of these flexible pipes is well known and described, for example, in FR-A-2 553 859.

The operations of laying and/or testing the flexible pipes or certain other operations employing remote-controlled means such as underwater vehicles known as ROVs (Remote Operated Vehicles) require the use of other pipes which may be of the flexible pipe type, the structure of which is similar to that of the flexible production pipes which are used for abandonment and/or for recovering the main pipes, or of the umbilical type which is also well known to specialists in this field. The various structures of the pipes in use in the oil industry are, for example, described and referenced in the various API (American Petroleum Institute) publications.

The operations of laying a flexible pipe have sometimes to be broken off as a matter of urgency, for example in the event of fierce storms. This interruption is performed using either a winch paying out a steel cable which is connected to the flexible pipe, so as to set down on the sea bed one end of a portion of the flexible pipe which was in the depositing phase, or a secondary pipe of the flexible pipe type, as is described in FR-A-2 056 428.

At all events, the surface equipment such as a laying vessel comprises different holding and storage means, some of these means being associated with the main flexible production pipe, and others being associated with the secondary pipes as opposed to the main flexible pipe. Now, for medium and great depths of between 1000 and 2500 m, and even more, the means for holding and storing the main and secondary pipes have to be of very large size. For long lengths of main flexible pipe, baskets are generally used and are similar to the one depicted in the drawings of U.S. Pat. Nos. 3,804,111 and 3,941,146. Such baskets have an outside diameter of between 10 and 15 m. The secondary pipes such as an abandonment flexible pipe, like the one depicted in FR 2056428, are spooled onto reels, the payload of which is restricted to 250–300 tonnes, which corresponds to a length of secondary pipe of between 1500 and 2000 m.

It is quite clear that such storage means, baskets and/or reels, take up a very great deal of space on the deck of a laying vessel, thus restricting the amount of space available for the manoeuvres which are essential to laying, tests and/or recovering a main flexible pipe or alternatively for storing other equipment. In addition, there is no need to remind the reader that the longer the lengths of main flexible pipe and secondary pipe, the larger and more numerous the storage means will be.

In certain cases, the capacity of the baskets allows the storage either of a very great length of flexible pipe or several different pipes of different lengths and diameters. When this is the case, the basket is filled according to the sequence in which the pipes will be laid. Thus, the first pipe loaded into the bottom of the basket will be the last to be laid, whereas the last pipe loaded into the basket will be the first to be laid. When use is made of an abandonment and recovery pipe which needs to be used on any pipe that is to be laid, it cannot be stored in the basket containing the various pipes and has therefore to be stored on an independent reel.

The object of the present invention is to provide a device which makes it possible to hold and store at least one main pipe and one secondary pipe on one and the same means, so as to reduce the amount of space occupied by this storage means on the deck of the laying vessel or of another equivalent surface structure from which the said pipes are handled.

The subject of the present invention is a device for holding and storing at least two distinct spoolable pipes, one of which consists of a main first flexible pipe used in offshore oil operations, the said device comprising a first cylindrical structure and a second cylindrical structure with different diameters, the main first flexible pipe being held and stored in a first cylindrical structure, the two cylindrical structures being concentric, able to rotate about an approximately vertical axis of rotation and having an upper face which is open and a lower face which is closed by an end plate, and means for rotating the said cylindrical structures, and it is characterized in that the secondary second pipe is arranged in the second cylindrical structure which comprises three distinct and concentric housings, the two end housings, namely the innermost housing and the outermost housing, being for holding and storing the said secondary second pipe, the central housing constituting a transition zone for the passage of the said secondary pipe between the innermost and outermost housings.

One advantage of the present invention lies in the fact that it is possible to hold and store two pipes of different, similar, analogous or identical structures in one same device such as a basket, of a size which is smaller than was the case in installations of the prior art. In addition, it is possible to coil and uncoil the pipes stored in the corresponding cylindrical structures independently of each other.

According to another feature of the present invention, the central housing comprises a member for supporting and guiding the secondary second pipe as it passes between the upper end of one end housing to the lower end of the other end housing.

That makes it possible for the secondary pipe to be guided suitably from one end housing to the other without the risk of deformation or deterioration of the interior structure of the said secondary pipe. Thus, the secondary pipe is not bent excessively, which is important when it comprises tensile armour and/or pressure armour. In other words, and when the secondary pipe is analogous to a flexible pipe, as is the case in the use of abandonment or recovery of a flexible pipe, the secondary pipe is not deformed to a radius of curvature smaller than the minimum bend radius (MBR).

Other features and advantages will become apparent from reading about one preferred embodiment of the invention, and from the appended drawings in which.

Figure 1:
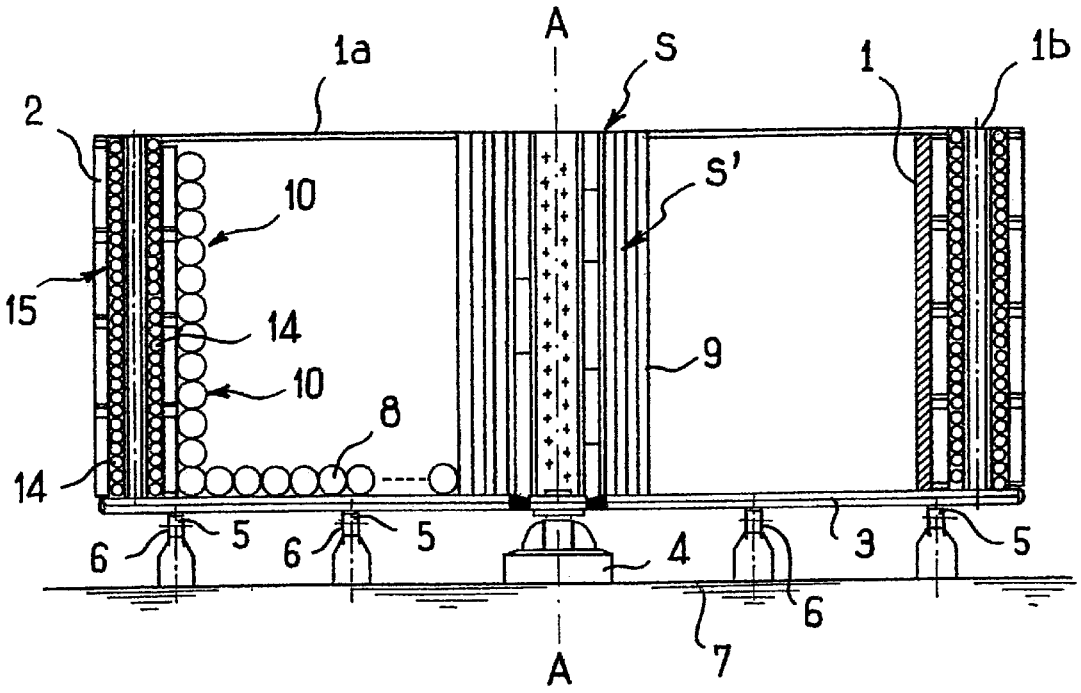
FIG. 1 is a view in section of the device according to the invention.

FIGS. 3*a* to 3*f* are diagrammatic depictions viewed from above of the spooling of the secondary pipe.

The device for holding and storing pipes comprises a first cylindrical structure 1 of approximately vertical axis A, and a second cylindrical structure 2 concentric with the first cylindrical structure 1. In actual fact, other internal cylindrical structures S are also provided, and serve to house other components needed for rotating the entire device, which components, being well known to experts in the field, will not be described in detail. These other structures S' constitute the shank of the storage basket.

The concentric cylindrical structures 1 and 2 are open at their upper face 1*a,* 1*b* to allow the introduction of the pipes that are to be stored, and are closed at their lower face by an end plate 3 which is common, in the example depicted, to the said structures 1 and 2. The device is able to be rotated about the axis A and is driven by a hydraulic or electric motor 4. Wheels 5 allow the device to run on rails 6 fixed to the floor 7 which, in this particular instance, is the deck of a laying vessel or barge. The internal structure 1 is intended to hold a main flexible pipe 8, as described, for example, in API 17B or FR 2056428, the main pipe 8 being spooled from the hub 9 to the periphery then in successive layers 10 up to the top of the cylindrical structure 1, as depicted diagrammatically in FIG. 1. The diameter of the cylindrical structure 1 is about 16 m, which allows a long length of flexible pipe 8 to be stored.

Figure 2:
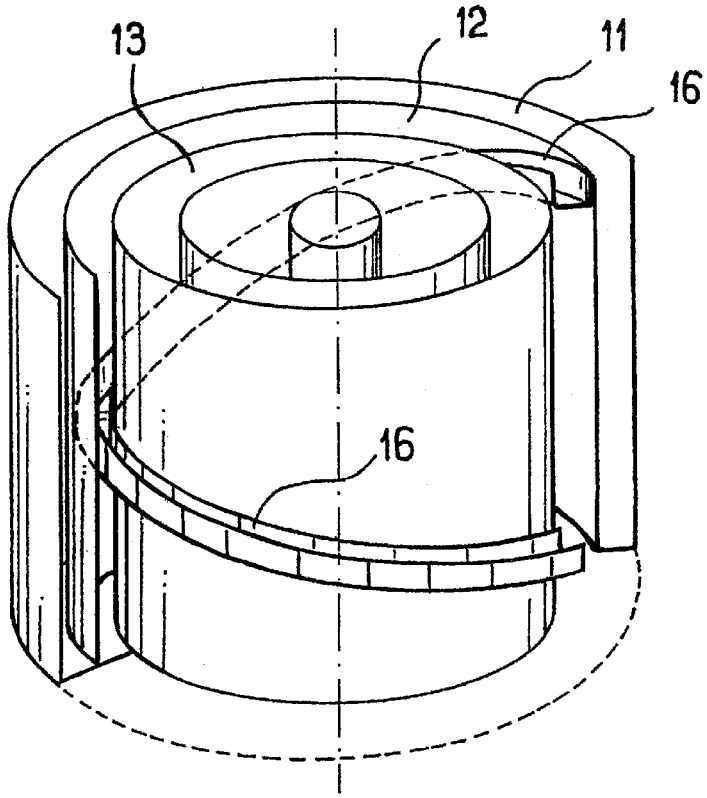
FIG. 2 is a view in perspective with partial cutaway of the housings for the secondary pipe and of the guide and support means arranged in the central housing.

The second cylindrical structure 2 known as the external structure is located, in the embodiment depicted, on the outside of the cylindrical structure 1 known as the internal structure, although this configuration could be reversed if need be. The external cylindrical structure 2 comprises at least three mutually concentric housings 11, 12, 13 with a vertical axis of symmetry parallel to the axis of rotation A. The end housings 11 and 13 are intended to hold the secondary pipe 14 which is spooled and stored in stacked successive layers 15 as depicted in FIG. 1. The housing 12 is intended to allow the secondary pipe 14 to pass from the top of the outermost end housing 11 to the bottom of the innermost end housing 13. In order to avoid deformation or deterioration and to provide the secondary pipe 14 with appropriate guidance, the central housing 12 is equipped with a ramp 16 which extends over half a circumference in the instance depicted in FIGS. 2 and 3, the objective being to lead the secondary pipe 14 into the bottom of the innermost end housing 13 in such a way as to allow it to be spooled in successive layers up to the top of the said innermost end housing 13. The passage of the secondary pipe 14 from the central housing 12 into the innermost end housing 13 is through an orifice, not depicted, formed in the end plate 3.

Figure 3A:
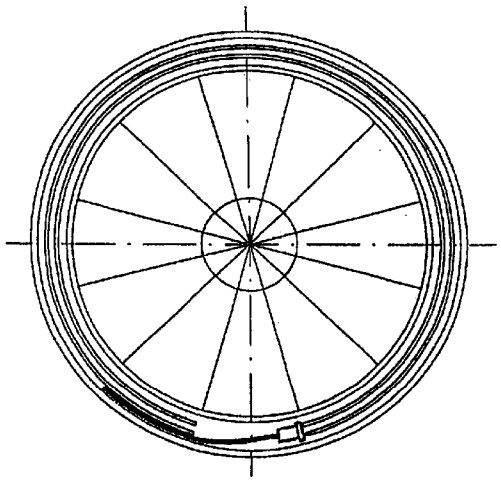
Figure 3B:
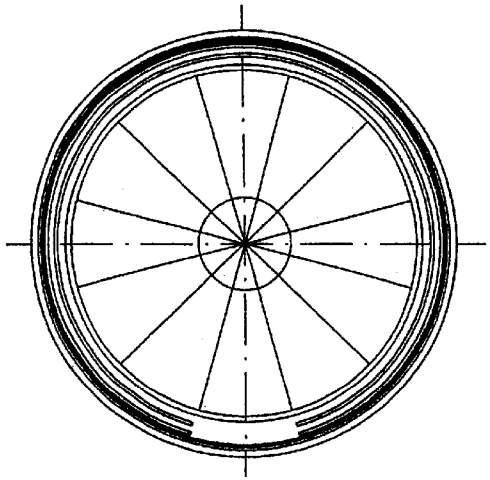
Figure 3C:
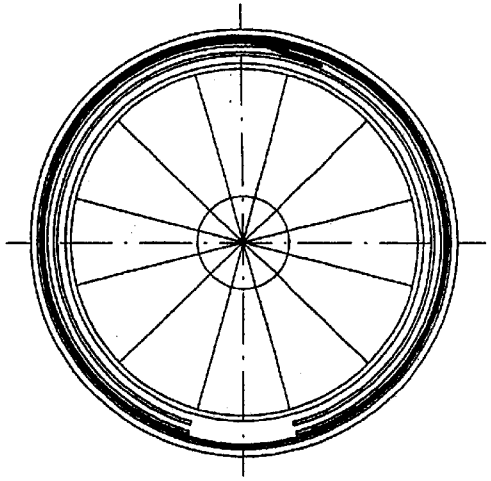
Figure 3D:
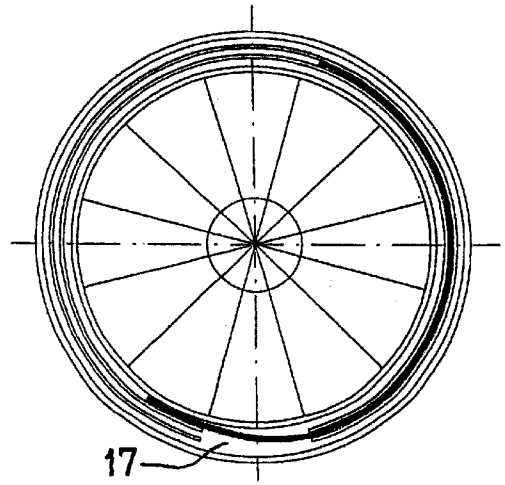
Figure 3E:
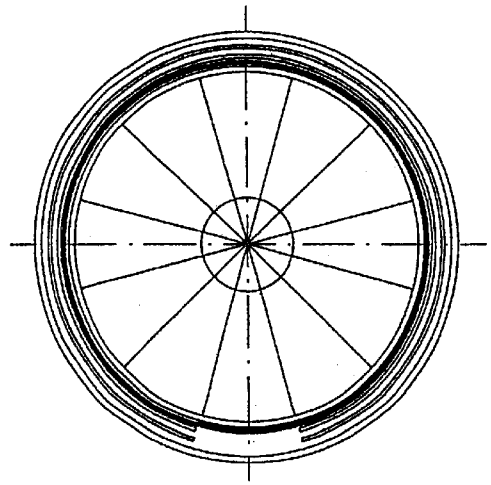
Figure 3F:
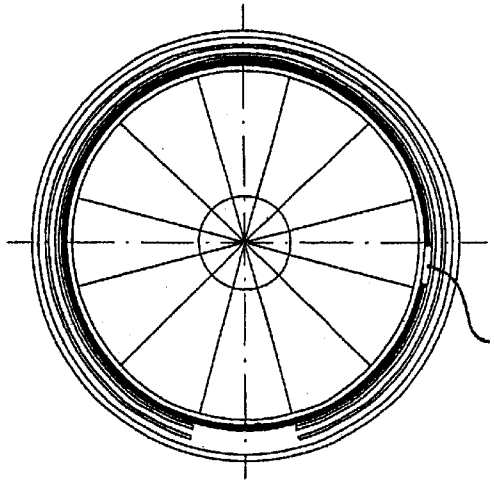

The way in which the secondary pipe 14 is spooled in the outermost 11 and innermost 13 end housings is depicted diagrammatically in FIGS. 3*a* to 3*f*. Once appropriate means have been used to secure one end of the secondary pipe to the device, the device is rotated, so as to coil the secondary pipe from the bottom to the top of the outermost end housing 11 (FIGS. 3*a* and 3*b*). When the secondary pipe 14 is at the top of the housing 11, it is then introduced into the central housing 12 (FIG. 3*c*) over approximately half a turn or circumference and it is supported and guided on the ramp 16 until it reaches a transfer zone 17 (FIG. 3*d*) and is then introduced into the bottom of the housing 13 in which it is spooled up to the top of the said housing 13 (FIG. 3*e*), after which its end is held fixed in this position by fixing and holding means 18 well known to specialists in the field, such as adjustable straps. The width of each housing 11 to 13, in cross section, is slightly greater than the diameter of the secondary pipe 14 which is to be stored in the device. By way of example, the secondary pipe for all applications envisageable at the depths concerned has an inside diameter of about 130 mm and an outside diameter of about 240 mm, which allows a weight of main pipe of about 550 tonnes to be taken. The width of the housings for the secondary pipe is between 300 and 400 mm. The height of the device from the end plate 3 to the open face of the structures 1 and 2 is 7.5 m.

Of course, the second cylindrical structure 2 may hold other types of secondary pipe such as umbilicals. Likewise, and although this has not been depicted, the two cylindrical structures 1 and 2 can be dissociated while at the same time being concentric, and each be provided with their own rotational-drive means. In this case, the rotational speeds of the said structures would be different, which could allow, for example, the secondary pipe to be spooled or unspooled at a speed higher or lower than the speed of the main flexible pipe.

What is claimed is:

1. A device for holding and storing at least two distinct spoolable pipes (8, 14), one of which consists of a main first flexible pipe (8) used in offshore oil operations, said device comprising a first cylindrical structure and a second cylindrical structure with different diameters (1, 2), the main first flexible pipe (8) being held and stored in a first cylindrical structure (1), the two cylindrical structures (1, 2) being concentric, able to rotate about an approximately vertical axis of rotation (A) and having an upper face (1*a,* 1*b*) which is open and a lower face which is closed by an end plate (3), and means (4) for rotating said cylindrical structures, wherein the secondary second pipe (14) is arranged in the second cylindrical structure (2) which comprises three distinct and concentric housings (11, 12, 13), the two end housings, namely the innermost housing (13) and the outermost housing (11), being for holding and storing said secondary second pipe (14), the central housing (12) constituting a transition zone for the passage of said secondary pipe (14) between the innermost and outermost housings (11, 13).

2. The device as claimed in claim 1, wherein the central housing (12) comprises a member (16) for supporting and guiding the secondary second pipe (14) as it passes between the upper end of one end housing (11) to the lower end of the other end housing (13).

3. The device as claimed in claim 2, wherein the support and guiding member consists of a ramp (16).

4. The device as claimed in claim 1, wherein the cylindrical structure (2) associated with the secondary pipe (14) is formed on the outside of the cylindrical structure (1) associated with the first flexible pipe (8).

5. The device as claimed in claim 1, wherein the two cylindrical structures (1, 2) rotate as one.

6. The device as claimed in claim 1, wherein the two cylindrical structures (1, 2) are distinct and can be rotated at different speeds.

7. The device as claimed in claim 1, wherein the secondary pipe (14) consists of a flexible pipe of a similar structure to the first flexible pipe.

8. The device as claimed in claim 1, wherein the secondary pipe (14) consists of an umbilical which can be housed and stored in the housings (11, 13) of the second structure (2).

* * * * *